US007575185B2

(12) United States Patent
Hammonds et al.

(10) Patent No.: US 7,575,185 B2
(45) Date of Patent: Aug. 18, 2009

(54) BEVERAGE AND ICE DISPENSER CAPABLE OF SELECTIVELY DISPENSING CUBED OR CRUSHED ICE

(75) Inventors: Marcus M. Hammonds, New Rochelle, NY (US); William W. Segiet, Bethel, CT (US); Fernando A. Ubidia, Ludlow, MA (US); Aaron Stein, Middletown, CT (US)

(73) Assignee: PepsiCo, Inc., Purchase, NY (US)

( * ) Notice: Subject to any disclaimer, the term of this patent is extended or adjusted under 35 U.S.C. 154(b) by 702 days.

(21) Appl. No.: 11/318,698

(22) Filed: Dec. 27, 2005

(65) Prior Publication Data

US 2006/0169721 A1 Aug. 3, 2006

Related U.S. Application Data

(60) Provisional application No. 60/648,893, filed on Feb. 1, 2005.

(51) Int. Cl.
*B02B 1/08* (2006.01)
*B02B 5/02* (2006.01)
*B02C 21/00* (2006.01)

(52) U.S. Cl. ..... 241/35; 241/DIG. 17

(58) Field of Classification Search ..... 241/DIG. 17, 241/65; 62/344; 222/132, 135, 146.6, 129.1, 222/226, 227, 236, 239–242
See application file for complete search history.

(56) References Cited

U.S. PATENT DOCUMENTS 2,645,910 A * 7/1953 Leeson ..... 62/71
3,602,441 A * 8/1971 Alvarez ..... 241/101.2
4,786,002 A * 11/1988 Mitsubayashi et al. ... 241/101.8
4,856,682 A 8/1989 Miller et al.
4,927,087 A * 5/1990 Palochak ..... 241/101.01
4,946,073 A 8/1990 Brill et al.
4,972,999 A 11/1990 Grace
5,037,004 A 8/1991 Katz et al.
5,056,688 A 10/1991 Goetz et al.
5,058,773 A 10/1991 Brill et al.
5,125,242 A 6/1992 von Blanquet
5,148,996 A * 9/1992 Fletcher et al. ..... 241/36
6,655,166 B1 12/2003 Williams
2003/0230108 A1 12/2003 Lucas et al.
2004/0099076 A1 5/2004 Haskin et al.
2006/0168984 A1* 8/2006 Myers ..... 62/344

* cited by examiner

*Primary Examiner*—Bena Miller
(74) *Attorney, Agent, or Firm*—Banner & Witcoff, Ltd.

(57) ABSTRACT

A beverage and ice dispenser that dispenses both beverages and cubed or crushed ice. Beverages are dispensed from dispensing heads. Cubed ice is stored in a bin. A duct leads from the bin. The duct has first and second outlet openings. A chute leads from the outlet openings. The chute has a single discharge opening from which ice from both duct outlet openings is discharged. An ice crusher is between a first outlet opening and the chute. A gate opens and blocks the flow path from the second opening into the chute. When cubed ice is desired, the gate is spaced from the second opening so that cubed ice is discharged from the duct and chute. When crushed ice is desired, the gate closes the second opening. Ice flows out of the first opening, is crushed by the ice crusher and discharged through the chute.

14 Claims, 8 Drawing Sheets

BEVERAGE AND ICE DISPENSER CAPABLE OF SELECTIVELY DISPENSING CUBED OR CRUSHED ICE

CROSS-REFERENCE TO RELATED APPLICATION

This application claims the benefit of U.S. Provisional Application No. 60/648,893, filed Feb. 1, 2005, the entire disclosure of which is incorporated herein by reference.

FIELD OF THE INVENTION

The present invention is generally related to a beverage and ice dispenser. More particularly, this invention is related to a self-serve beverage and ice dispenser that allows a customer to selectively dispense ice that is either cubed or crushed.

BACKGROUND OF THE INVENTION

At restaurants or other locations, a beverage is often formed from a dispenser as a mixture of syrup and water. Depending on the beverage, the water may or may not be carbonated. An advantage of dispensing beverage in this form is that the dispenser, syrup containers and a water supply typically occupy less space than is otherwise required to store the same volume of beverage in individual containers. Moreover, providing beverage from a dispenser eliminates the need for the establishment to have to deal with the waste formed by empty individual containers.

A typical beverage dispenser includes a number of dispensing heads. Each head is connected to a different source of syrup and a water source. Often, especially at a self-serve location, the beverage dispenser includes an ice dispenser. This allows a customer, at a single location, to fill a container with both ice and a beverage of choice. An advantage of this arrangement is that it allows the customer, without staff involvement, to fill the container with the specific proportions of ice and beverage preferred by the customer. This frees the staff from having to fill beverage containers so they are available for other duties. Moreover, many consumers enjoy having control over the volume and type of beverage and the quantity of ice they place in their own containers. Many commercially available beverage dispensers only dispense a single form of ice, cubed ice. This is because this is the form in which the ice is stored in the bin integral with the dispenser.

Some consumers prefer beverages with crushed rather than cubed ice. A simple solution to this concern is to place an ice crusher at the head of the discharge chute through which the ice is discharged. The crusher would automatically crush the cubes prior to their discharge. Alternatively, the ice bin is filled with crushed ice. This would eliminate even the need to provide an ice crusher.

A disadvantage to the above solutions is that the dispenser would not dispense cubed ice. Customers who prefer this type of ice with their beverages would be disappointed.

SUMMARY OF THE INVENTION

This invention is directed to a new and useful integrated beverage and ice dispenser. The dispenser of this invention has an ice bin in which cubed ice is stored. A duct that extends from the ice bin serves as a conduit for the ice to be discharged. Mounted to the duct is an ice crusher. The duct also has a bypass opening. Both the ice crusher and bypass opening open into a common ice chute. An auger disposed in the duct pushes the cubed ice from the ice bin towards the crusher and bypass opening.

The ice crusher and the auger are driven by separate motors. The use of separate motors allows for completely independent control of the auger and ice crusher and increases the flexibility of the invention over previous ice crushers. The speed of the auger can be adjusted without affecting the speed of the ice crusher, and vice-versa. As a result the invention is capable of crushing and dispensing different types of ice produced by the multitude of ice makers available. The rate at which the auger feeds ice to the crusher and the speed of the crusher can each be adjusted to optimally crush and dispense ice of different geometries and densities. Another advantage of independent motors for the auger and crusher is that when cubed ice is dispensed the crusher motor can be deactivated. This will render the crusher idle, allowing no further ice crushing to occur, and only cubed ice will be dispensed so that the customer is assured of receiving the desired type of ice. Additionally, the two-motor system allows the ice dispenser to perform ice jam corrections that would be difficult with a single-motor system, such as variable auger and crusher rotation speeds and independently reversible auger and crusher directions.

A gate selectively opens and closes the bypass opening. Opening and closing of the gate is accomplished by means of a motor-driven worm drive, or other means such as a solenoid, pneumatic or hydraulic cylinder, or other actuating device. When a consumer wants crushed ice from the dispenser assembly of this invention, the gate over the bypass opening is held closed and the auger causes the ice to be delivered to the crusher. The crusher pulverizes the cubes so they turn into crushed ice. The crushed ice is discharged to the customer through the chute.

Alternatively, when a customer wants cubed ice, the gate is opened and the auger is actuated. The cubed ice moves through the duct and is discharged through the bypass opening and chute into the customer's container. The beverage dispenser of this invention allows a customer to selectively discharge cubed or crushed ice into a container. Thus, the dispenser provides the consumer with an additional choice regarding the form of the final beverage. Providing the added option of cubed or crushed ice makes the consumer's dispensing of the beverage a more enjoyable experience.

Another feature of the dispenser of this invention is that both the cubed ice and crushed ice are discharged from the same chute. The possibility that a customer could place the container under one chute and have ice discharged from a second chute is nonexistent.

Unlike existing ice crushers, the bypass gate is located external of the ice crusher. This reduces the delay time when changing the selection between cubed and crushed ice, and reduces the complexity of the ice dispenser.

Another feature of the invention is the self-contained, modular design of the ice dispenser, which permits the ice dispenser to be easily configured for use either as a stand-alone ice crusher or for integration with a beverage dispenser. The modular design is an advantage for the manufacture of a beverage and ice dispenser appliance since the ice dispenser can be procured as a single subassembly. Further, the modular design also reduces the complexity of servicing the beverage and ice dispenser because the ice dispenser can be removed and replaced as a unit.

The ice dispenser of the invention utilizes an auger with a two-bladed paddle at its end. The paddle blades exert a positive force on the ice, pushing it into the ice crusher, resulting in faster and more consistent ice dispensing than existing equipment. The blades are made of a flexible material such as rubber, to aid in the reduction of ice jams. If an ice jam does occur within the crusher, the soft paddle blade material will fold over itself, permitting the auger to continue to turn.

Another feature of the invention is that the ice crusher blades rotate at a high speed. In addition to crushing the ice, the blades also increase the velocity of the ice as it exits the crusher assembly, which results in a high rate of dispensed ice.

BRIEF DESCRIPTION OF THE DRAWINGS

The invention is pointed out with particularity in the claims. The above and further features and benefits of the invention are better understood by reference to the following detailed description taken together with the accompanying drawings in which:

DETAILED DESCRIPTION

Figure 1:
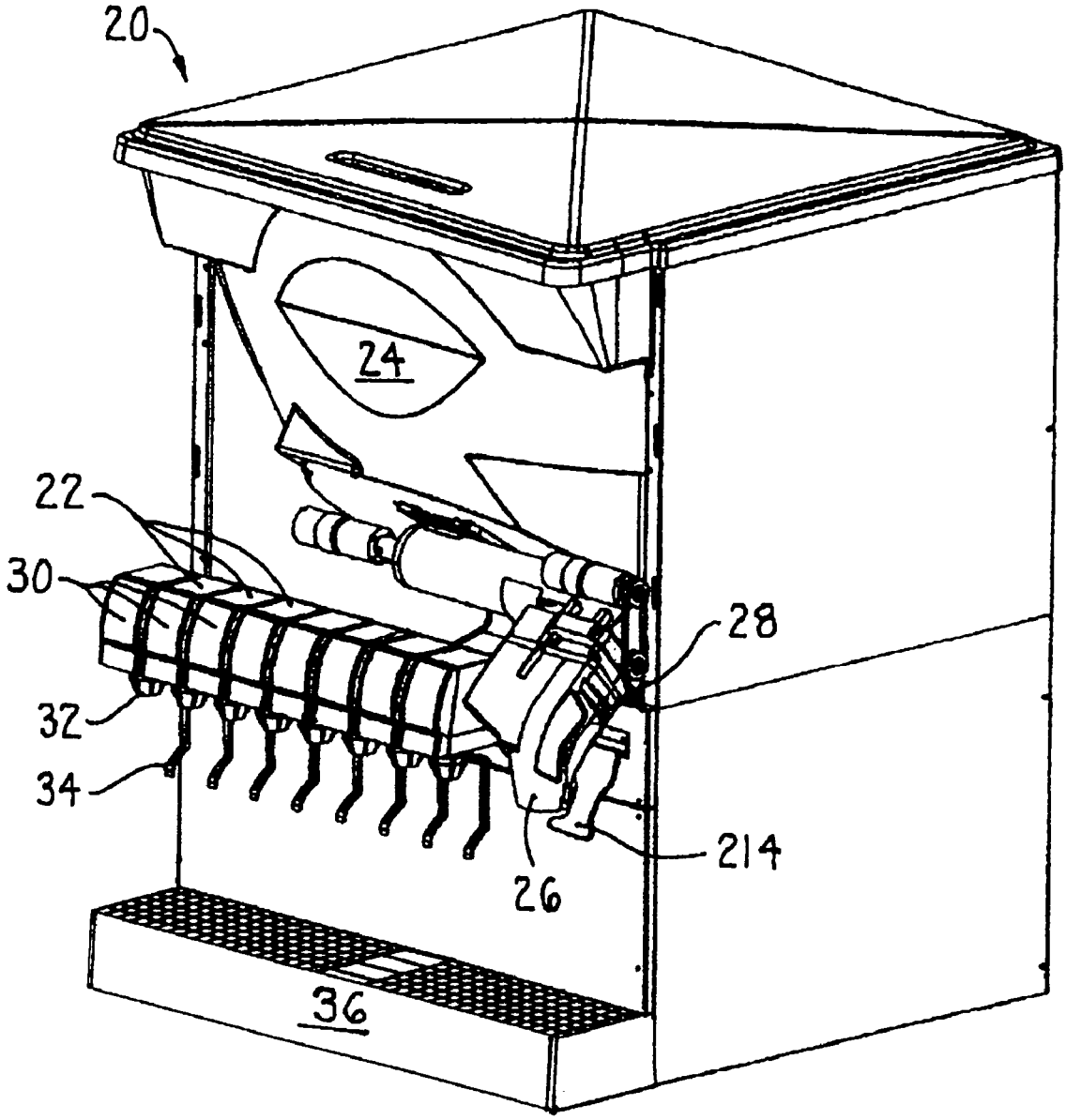
FIG. 1 is a front perspective view of a beverage dispenser of this invention, with the front cover removed, illustrating the ice dispenser.
Figure 2:
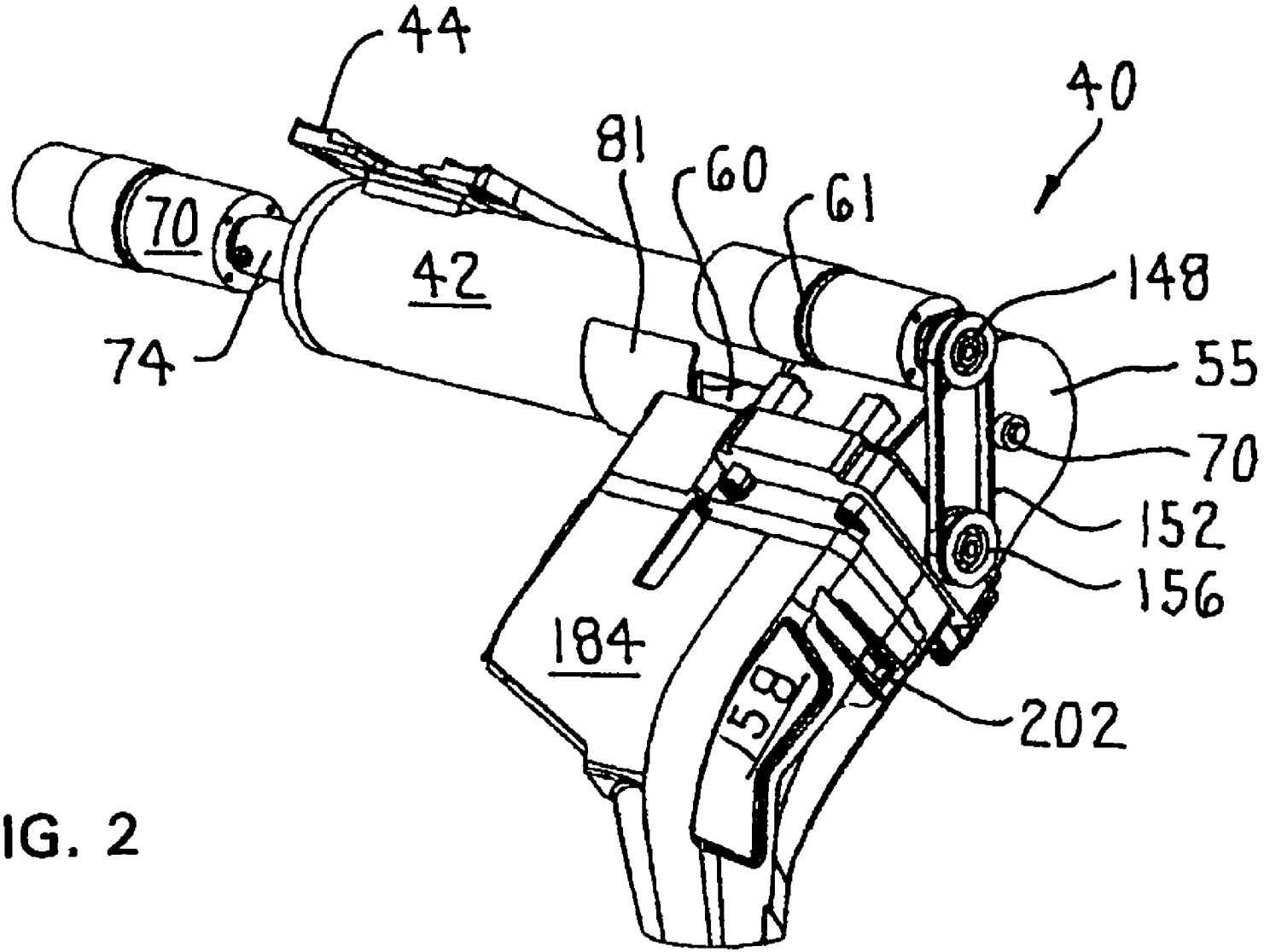
FIG. 2 is a first perspective view of the ice dispenser.

FIG. 1 illustrates a beverage dispenser 20 constructed in accordance with this invention. Dispenser 20, shown with the front cover removed, has a plurality of dispensing head assemblies 22 from which separate blended beverages are individually dispensed. The dispenser 20 has an ice bin 24. Ice in cubed form is stored in bin 24. Ice in the bin 24 is discharged to the customer through a chute 26. An ice crusher 28 is attached to the rear end of chute 26. (For a point of reference, "front" and "forward" are understood to mean towards the dispenser 20 openings through which beverage or ice is discharged. "Rear and "rearward" are understood to mean away from the openings through which beverage or ice is discharged.) The ice crusher 28 selectively crushes the ice so that the customer may selectively receive ice that is either cubed or crushed.

Each dispensing head assembly 22 has a head unit 30 from which a downwardly-directed nozzle 32 extends. A lever arm 34 is pivotally attached to the head unit 30 and is positioned to extend under the nozzle 32. Beverage from a specific dispensing head assembly 22 is discharged by placing a container underneath the nozzle 32 to cause the displacement of the associated lever arm 34. A sensor (not illustrated) internal to the head unit 30 senses the displacement of the lever arm 34. The signal generated by the sensor is sent to a control circuit (not illustrated). The control circuit, in response to this signal, opens valves in the head unit 30 (valves not illustrated) that regulate the discharge of syrup and water. The valves are simultaneously opened so as to cause the discharge of a blended beverage comprising the syrup and water to the dispensing head. The structure of the lever arm, lever arm sensor, liquid control valves and control circuit is not relevant to the other features of the dispenser 20 of this invention. Therefore, these features are not further discussed.

A drip pan 36 is positioned below the dispensing head assemblies 22 and the chute 26. Drip pan 36 catches liquid and ice that are not discharged into a beverage container.

Chute 26 and crusher 28 are part of an ice dispenser 40 integral with beverage dispenser 20 now described by reference to FIGS. 2-5. The ice dispenser 40 also includes a tube-shaped auger duct 42. A plate shaped mounting flange 44 is molded with or otherwise integrally attached to the circumferential surface of the auger duct 42 at one end of the duct. The auger duct 42 is further formed to have an inlet opening 46 (shown in phantom in FIG. 4) that extends through the mounting flange 44 into the center void space of auger duct 42.

The ice dispenser 40 is positioned in the dispenser 20 so that the mounting flange 44 is disposed against the outer front wall of the ice bin 24. More particularly, the ice dispenser 40 is positioned so that auger duct inlet opening 46 is in registration with an ice discharge opening formed in the front wall of the ice bin 24 (ice bin opening not illustrated). Fasteners (not illustrated) extend through openings 50 formed in the mounting flange 44 to secure the ice dispenser 40 to the rest of the beverage dispenser 20. In some versions of the invention, mounting plate flange openings 50 are keyhole-shaped openings. Pins with relatively large heads are permanently affixed to and extend out from the wall of the ice bin 24 to which the ice dispenser 40 is attached. In this version of the invention, ice dispenser 40 is removably attached to the ice bin 24 by positioning the mounting flange 44 so that the ice bin pins seat and lock in the flange openings 50. This feature makes it easy to remove and replace ice dispenser 40 for maintenance.

Figure 5:
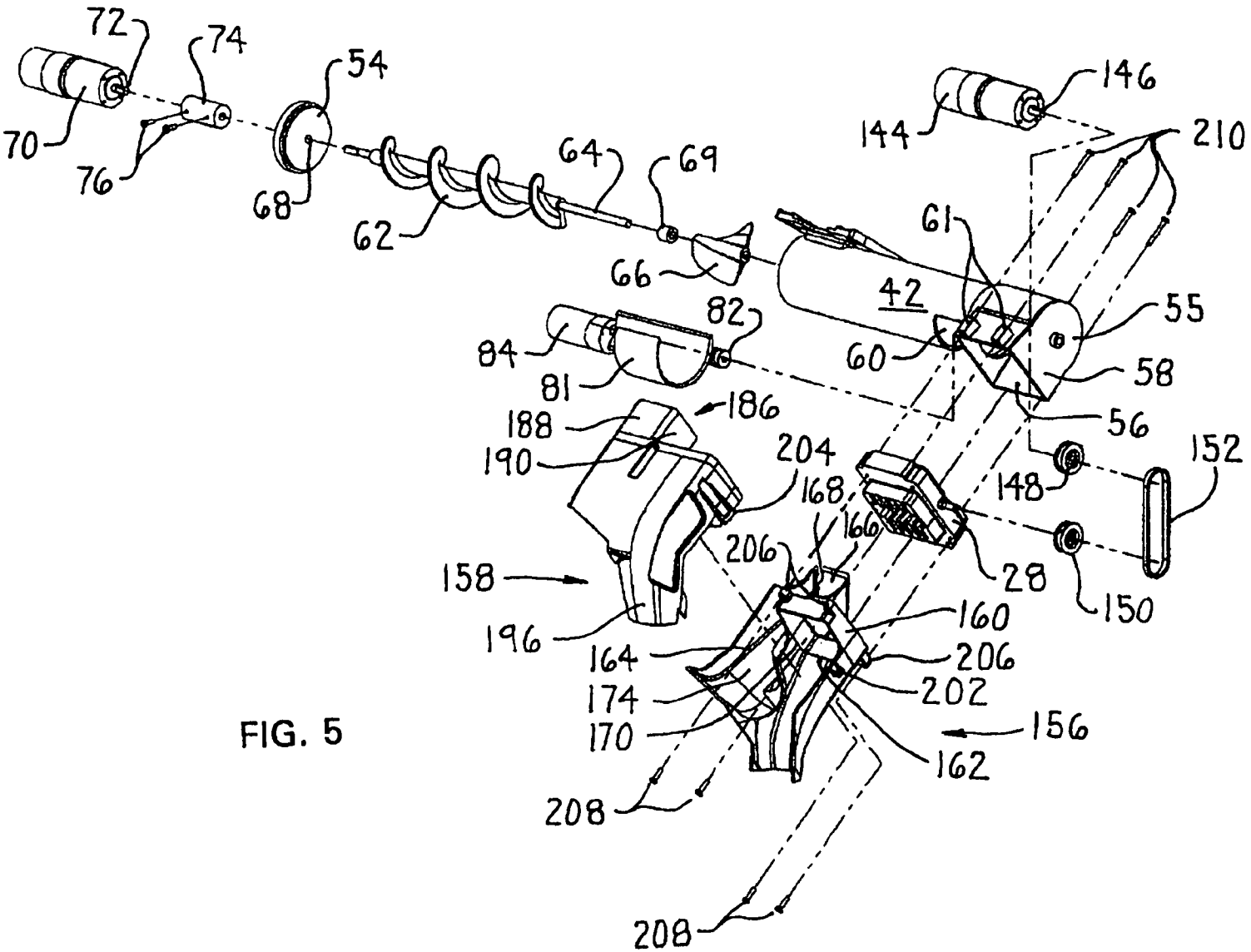
FIG. 5 is an exploded view of the ice dispenser.

The end of auger duct 42 adjacent mounting flange 44 is closed by a disc-shaped end cap 54 (shown in FIG. 5). In the depicted version of the invention, an end cap 55 formed integrally with the auger duct 42 closes the opposed end of the duct. The auger duct 42 is further formed to have two laterally directed, longitudinally aligned and longitudinally spaced apart openings adjacent the end opposite mounting flange 44. A first opening, primary opening 56, is located immediately rearward the end of the duct. In the depicted version of the invention, the auger duct 42 is formed with a rectangular-shaped flange 58 that surrounds primary opening 56 and extends laterally outward from the main circular body of the duct. The second opening, bypass opening 60, is located adjacent flange 58. The auger duct 42 is formed so that, relative to primary opening 56, bypass opening 60 is proximal to the duct inlet opening 46. The primary and bypass openings 56 and 60, respectively, are longitudinally aligned with each other.

Figure 8:
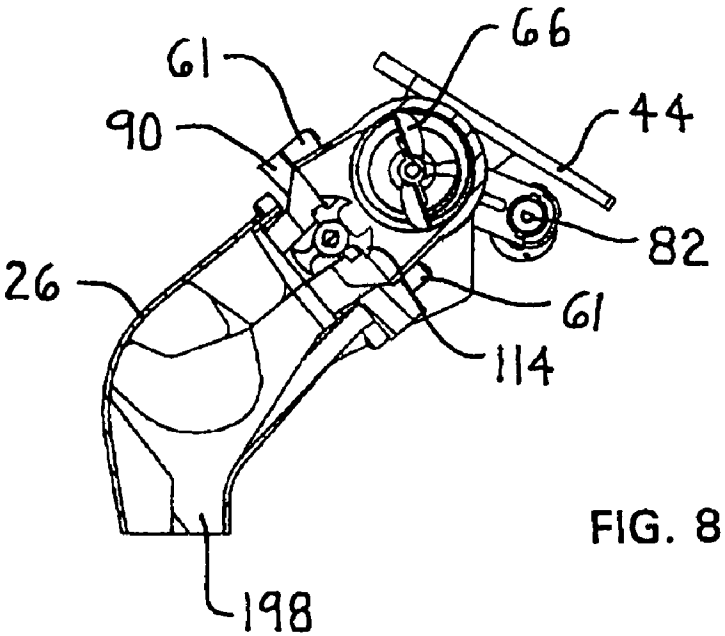
FIG. 8 is a cross sectional view of the ice crusher and discharge chute taken along line 8-8 of FIG. 4.

Auger duct 42 is further formed to have four rectangularly-shaped protuberances 61. Two of the protuberances 61 are positioned on the outer surface of the top wall of flange 58. The remaining two protuberances 61 (one illustrated in FIG. 8) are integral with and project outwardly from outer surface of the bottom wall of flange 58.

An auger 62 is disposed inside the auger duct 42. The auger 62 is disposed over an elongated shaft 64 that extends axially through the auger duct 42. One end of shaft 64 is mounted in and extends a short distance beyond a through hole 68 formed in end cap 54. The opposed end of shaft 64 is rotatably seated in a center-located boss 71 formed in end cap 55. Not identified is the opening in boss 71 in which the shaft 64 is seated. In some versions of the invention, sleeves formed of low friction material are positioned between the ends of shaft 64 and the static parts of the auger duct to function as bearings.

Auger 62 extends longitudinally through the auger duct 42 from duct inlet opening 46 to the bypass opening 60. The auger 62 is mounted to shaft 64 to rotate with the shaft. A paddle blade 66 is mounted to the end of the shaft 64 that extends through the space internal to the auger duct 42 subtended by primary opening 56. Paddle blade 66, like auger 62, is fitted to shaft 64 to rotate with the shaft. In the illustrated version of the invention, a cylindrical spacer 69 disposed on shaft 64 longitudinally separates the paddle blade 66 from the auger 62. Auger 62 is shaped so that, upon rotation, the auger pushes the ice cubes from duct inlet opening 46 towards primary opening 56 and bypass opening 60. Paddle blade 66 is shaped to, upon rotation, push ice cubes through the primary opening 56. Paddle blade 66 is preferably made of a flexible material, such as rubber, which allows the blade to fold so as to minimize the occurrence of ice jams.

Shaft 64 and, by extension, auger 62 and paddle blade 66, are rotated by an auger motor 70. The auger motor 70 is located adjacent end cap 54. Not shown is a bracket that holds auger motor 70 fast to either auger duct 42 or mounting flange 44. The auger motor 70 has an output shaft 72 directed toward end cap 54. A cylindrical coupling sleeve 74 couples the auger shaft 64 to the motor shaft 72 so the two shafts move in unison. As seen in FIG. 5, fasteners 76 that extend into laterally directed openings in sleeve 74 (openings not identified) hold the two shafts 64 and 72 to the sleeve.

A bypass gate 80, also part of ice dispenser 40, selectively opens and closes the auger duct bypass opening 60. The bypass gate 80, best seen in FIGS. 3 and 5, has a curved main body 81 that surrounds an arcuate section of the auger duct 42. Bypass gate 80 is mounted to a threaded drive shaft 82. The drive shaft 82 is rotated by and suspended from a bypass gate motor 84. In the depicted version of the invention, the bypass gate motor 84 is laterally spaced from the auger duct 42 and located in front of the mounting flange 44. Not shown is a bracket that holds the bypass gate motor 84 to the mounting flange 44.

Figure 3:
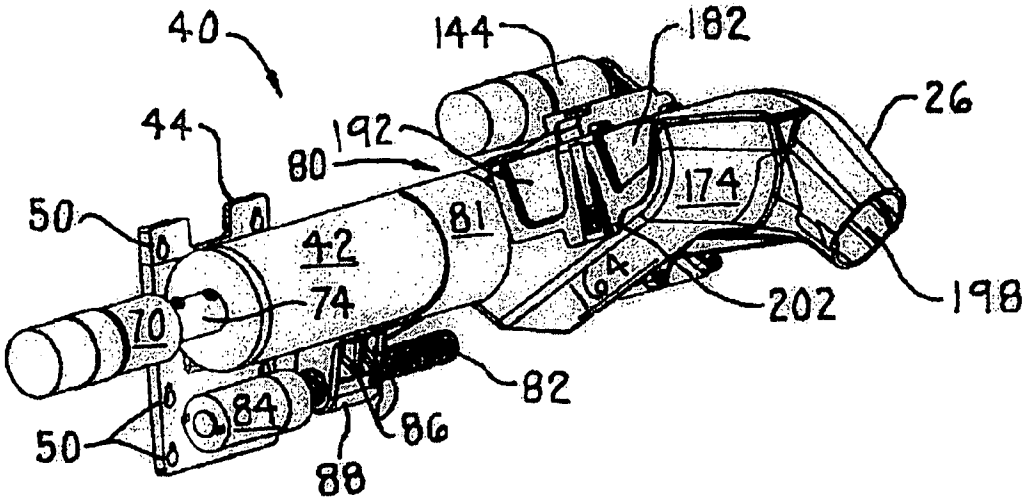
FIG. 3 is second perspective view of the ice dispenser assembly taken from the side opposite the side of the view of FIG. 2.

In addition to the curved main body 81, bypass gate 80 has three parallel aligned and spaced apart tabs 86 that extend away from the plate main body (see FIG. 3). A sleeve 88 with a through bore that has interior threading (through bore not illustrated) is held away from the gate main body 81 by tabs 86. Sleeve 88 is the bypass gate component that threadedly engages drive shaft 82. The rotation of the drive shaft 82 causes the bypass gate 80 to move longitudinally along the length of the auger duct 42. The bypass gate 80 is positioned relative to the auger duct 42 so that when the gate main body 81 is spaced distally from the bypass gate motor 84, the gate main body covers the duct bypass opening 60. When the bypass gate 80 retracts towards motor 84, the gate main body 81 moves away from the bypass opening 60. Alternately, bypass gate 80 may be driven by an electric solenoid, a hydraulic or pneumatic cylinder, or some other type of known actuation device.

Figure 6:
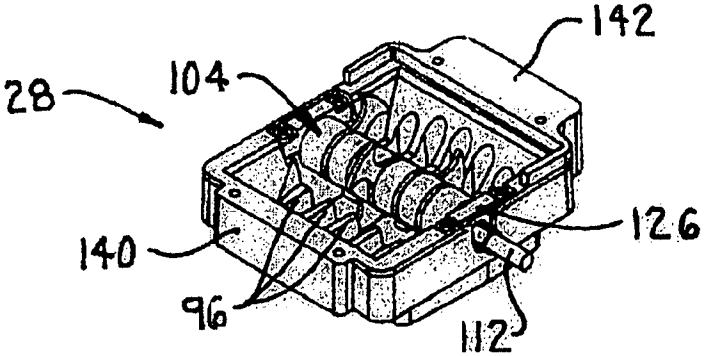
FIG. 6 is a perspective view of the ice crusher integral with the ice dispenser.
Figure 7:
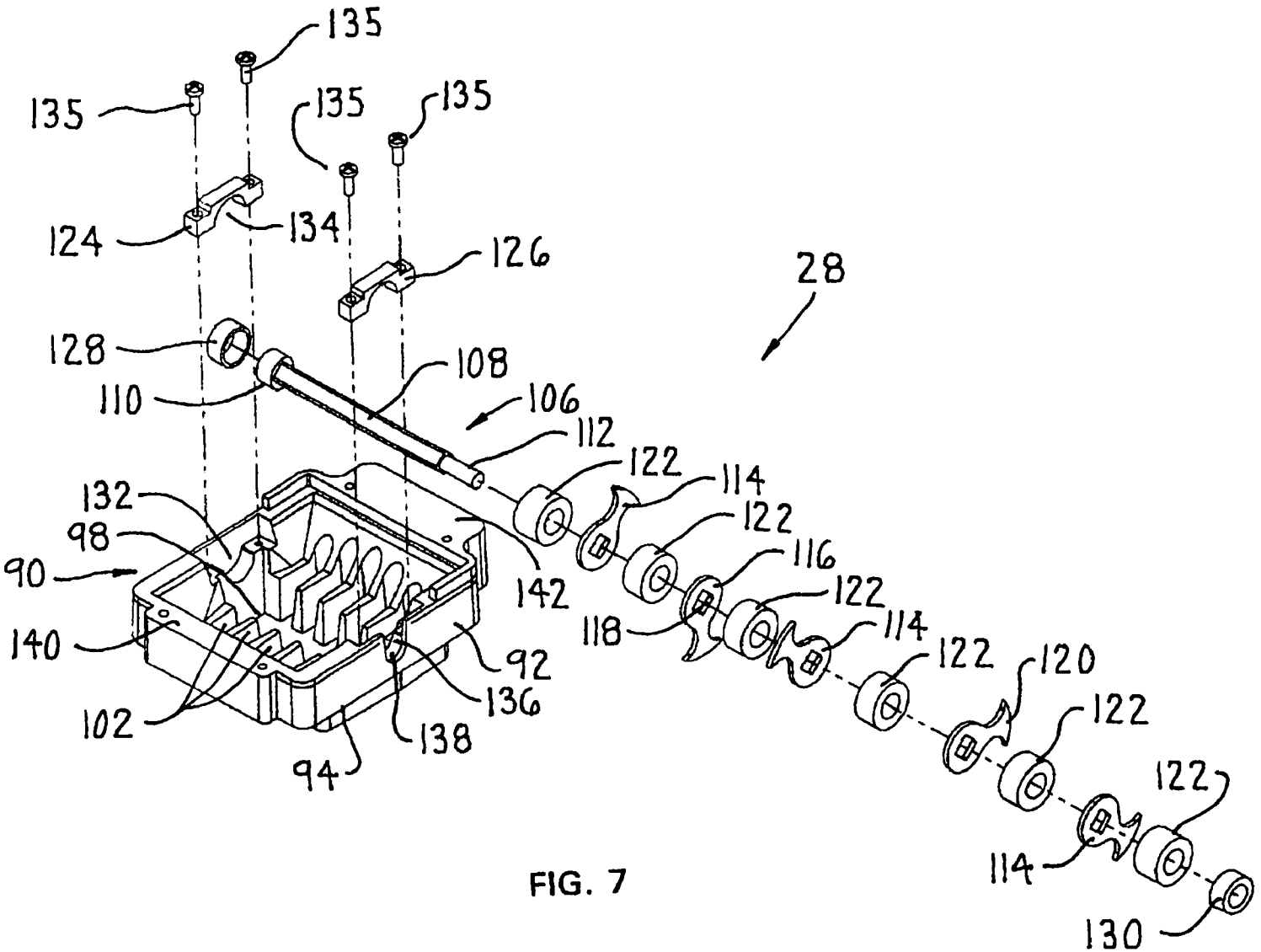
FIG. 7 is an exploded view of the ice crusher.
Figure 9:
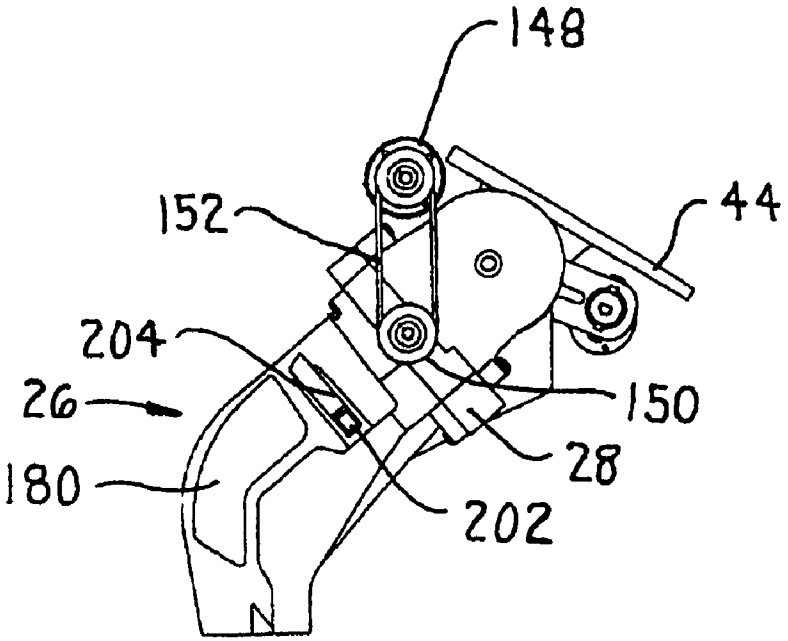
FIG. 9 is a side view of the ice dispenser illustrating the connection between the ice crusher and the motor that actuates the ice crusher.

FIGS. 6 and 7 illustrate the ice crusher 28 of the beverage dispenser 20 of this invention. Ice crusher 28 includes a base 90 formed of a single piece of rigid material. Base 90 has a generally square frame 92. A head 94 projects forward, towards chute 26, from the frame 92.

Head 94 is formed to have two rows of parallel stationary blades 96. The two rows of stationary blades 96 are spaced apart from each other to define an elongated gap 98 in the head 94 that extends along the longitudinal axis of the head. In each row, the individual stationary blades 96 are spaced apart from each other to define a longitudinally extending slot 102 between each pair of adjacent blades. Each stationary blade 96 is further positioned to be longitudinally aligned with a blade in the opposed row. Thus, each slot 102 is aligned with a complementary slot 102 in the opposed row. Base 90 is further formed so that the stationary blades 96 have tapered cross-sectional profiles. Specifically, the rearward directed face of each stationary blade 96 has a relatively narrow cross sectional width; the forward directed face of the blade has wider cross sectional width. Slots 102 thus have tapered profiles opposite in direction to those of the stationary blades 96.

A moving blade assembly 104 is rotatably mounted to ice crusher base 90. Blade assembly 104 includes an elongated shaft 106 that seats in base gap 98. Shaft 106 has a main body 108 with a square cross-sectional profile. At one end of the main body 108, shaft 106 has a cylindrical head 110. Head 110 has a diameter larger than the cross sectional area subtended by the shaft main body 108. The opposed end of the shaft 106 has a cylindrical stem 112. Stem 112 has a diameter smaller than the cross sectional area subtended by the shaft main body 108.

A number of blades 114 are mounted to the shaft 106 to rotate with the shaft. Each blade 114 has a circular base 116. The blade base 116 is formed to have a center located opening 118. The blade base openings 118 are square in shape and are dimensioned to facilitate the close slip fitting of the blade bases 116 over the shaft main body 108. A head 120 is integrally formed with and extends radially outwardly from each blade base 116. The opposed surfaces that define the sides of the head 120 are inwardly curved. The edge surface that defines the top of blade head 120 curves outwardly.

Blade assembly 104 has a number of blades 114 equal to the number of pairs of opposed aligned slots 102 defined by the ice crusher base 90. Tube-shaped spacers 122 longitudinally separate the blades 114 along the length of the shaft main body 108. An additional spacer 122 is located over the shaft main body 108 between the shaft head 110 and the adjacent blade 114. A spacer 122 is located between the shaft stem 112 and the adjacent blade 114. When the blade assembly 104 is assembled, the individual blades 114 are oriented relative to each other so that the radial positions of the blade heads 120 are angularly spaced apart. The geometry of the blades is such that ice is crushed in either rotational direction, which provides greater effectiveness in eliminating ice jams.

Shaft retainers 124 and 126 and bushings 128 and 130 rotatably hold blade assembly 104 to the crusher base 90. At one end of the base 90, frame 92 has an inner section formed with a concave surface (not identified) that defines a circular notch 132 in which shaft head 110 is seated. Shaft retainer 124 seats over the shaft head 110 and holds shaft head 110 in position. While the shaft retainer 124 is generally in the form of a bar, the retainer has a concave surface 134 to facilitate the close seating of the retainer over shaft head 110. Fasteners 135 extend through holes formed in the shaft retainer 124 and frame 92 to hold the shaft retainer to the ice crusher frame 90 (holes not identified).

Bushing 128, formed of a solid low friction material, is disposed around shaft head 110. Bushing 128 provides a low friction interface between the rotating shaft 106 and the static ice crusher base 90 and retainer 124.

The side of the base frame 92 opposite the side that defines notch 132 is formed with an inwardly curved inner surface 136. Surface 136 is curved to define a notch (not identified) identical in shape to notch 132. The side of the base frame in which curved inner surface 136 is formed with a slot 138. Slot 138 opens into the notch defined by surface 136. When ice crusher 28 of this invention is assembled, the shaft stem 112 extends outwardly across frame inner surface 136 and out through slot 138.

Shaft retainer 126 seats over the shaft stem 112. The shaft retainer 126 has a shape similar to, if not identical to, that of shaft retainer 124. Bushing 130, formed from the same material as bushing 128, is disposed around the portion of shaft stem 112 that extends between the frame inner surface 136 and the shaft retainer 126 and through slot 138. Fasteners 135 hold the shaft retainer 126 to the ice crusher base 90.

The base frame 92 is further formed so that the surfaces that define the spaces in which the shaft 108, shaft retainers 124 and 126 and bearings 128 and 130 seat are recessed relative to the rear edge of the frame. Thus, blade assembly 104, with the exception of the blade heads 120, is disposed within the space enclosed by the base frame 92.

Ice crusher base 90 seats over the rectangular flange 58 of auger duct 42. To facilitate the mounting of the ice crusher 28 to the rest of the ice dispenser 40, the base frame 92 is formed on the top and bottom surfaces to have raised ribs 140 and 142, respectively. Each rib 140 and 142 extends the width of the frame surface with which the rib is integral. When the ice crusher 28 is seated against duct flange 58, ribs 140 and 142 abut the protuberances 61 integral with the flange.

Figure 4:
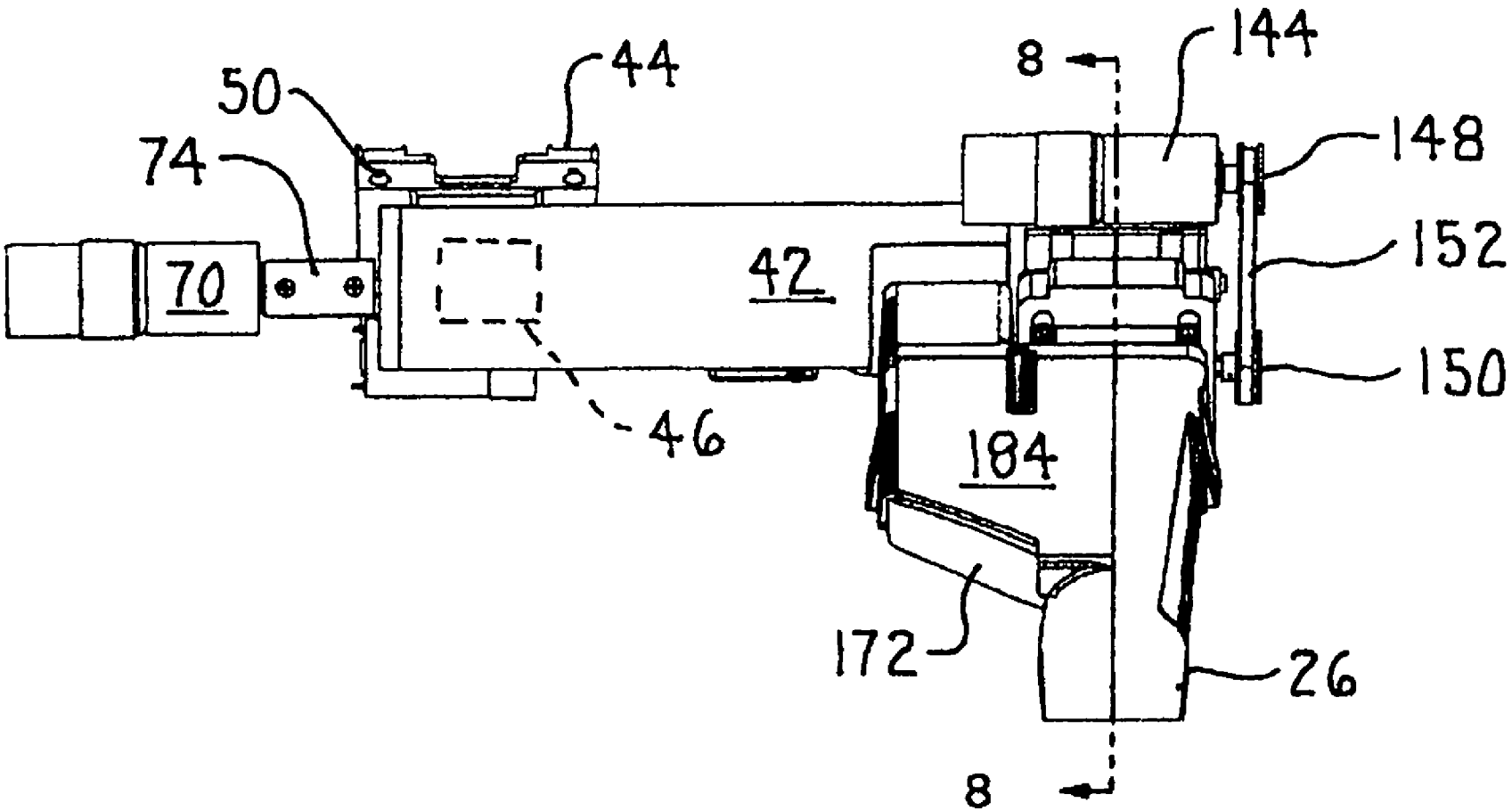
FIG. 4 is a plan view of the ice dispenser.

A crusher motor 144, best seen in FIGS. 4 and 5, rotates the moving blade assembly 104. The crusher motor 144 is located above the auger duct 42 adjacent the end of the duct to which the ice crusher 28 is mounted. Not illustrated is the bracket that holds the crusher motor 144 to the auger duct 42. Crusher motor 144 has a motor shaft 146 that extends parallel to shaft 64 internal to the auger duct 42. Motor shaft 146 extends a short distance beyond the adjacent closed end 55 of auger duct 42. Crusher motor 144 is controlled and operates independently of auger motor 70.

A pulley 148 is mounted for rotation to the free end of motor shaft 146. A complementary pulley 150 is mounted to the end of the blade assembly shaft stem 112 that extends beyond the crusher base 90. A drive belt 152 disposed around the pulleys 148 and 150 couples the pulleys for simultaneous rotation. Alternately, a roller chain and sprocket arrangement may be utilized instead of a drive belt and pulley arrangement to drive the ice crusher.

The ice chute 26, now described by reference to FIGS. 3, 4, 5, 8 and 9, is formed from bottom and top moldings 156 and 158, respectively. Lower molding 156 is shaped to have an open, rectangularly-shaped frame 160. Specifically, lower molding 156 is shaped so that frame 160 closely slip fits around the section of the ice crusher head 94 that extends forward of the ice crusher base frame 92. Extending forward and from frame 160, lower molding 156 has a first slide 162 that extends diagonally downwardly. The first slide 162 has a cross-sectional shape that transitions from three-sided (bottom surface and two opposed side surfaces) adjacent frame 160 to semi-circular adjacent the open end of the chute 26.

Bottom molding 156 is further shaped to have second slide 164 parallel to the first slide 162. The bottom molding 156 is formed so that the second slide 164 starts at a position rearward of frame 160. A plate 166 closes the most rearward end of the second slide, the end that extends beyond frame 160. This most-rearward section of the second slide 164 is formed as a three-sided structure; a base wall and two parallel, spaced apart side walls (individual wall sections not identified.) For reasons that are apparent below, side walls of the second slide 164 that extend rearward of frame 160 are formed to have concaved edges 168 which define a radius slightly greater than that defined by the bypass gate main body 81.

Chute bottom molding 156 is further formed so that, forward of frame 160, a single internal flange member 170 forms opposed sides of the first and second slides 162 and 164, respectively. Flange 170 terminates a short distance forward of frame 160 so that the flow path defined by the second slide 164 merges into the flow path defined by the first slide 162.

The chute bottom molding 156 is further formed to have a head piece 172. Head piece 172 extends forward from the outer wall of the molding 156 that defines the outer wall of the second slide 164. At the forward end of the bottom molding 156, the head piece 172 curves around and extends over the space where the flow path of the second slide 164 merges into the flow path of the first slide 162. Bottom molding 156 is further shaped so that a diverter panel 174 extends rearwardly from the free end of the head piece 172. Diverter panel 174 is disposed above the flow path defined by the first slide 162.

Top molding 158 is disposed over bottom molding 156. The top molding 158 is formed to have a first side wall 180 that projects upwardly from the outer wall of first slide 162. The top molding 158 has a second side wall 182 that extends upwardly from the outer wall of the second slide 164. A top wall 184, also part of top molding 158, extends between side walls 180 and 182. The ice chute 26 is further formed so that when top molding 158 is fitted over bottom molding 156, the top wall 184 is disposed over the top of the leading edge of frame 160 and over diverter panel 174.

Extending rearward from the top wall 184, the top molding 158 has a three-sided hood 186. Hood 186 extends rearward from the section of top molding 158 that extends laterally from the ice crusher base 90. A top wall 188 of hood 186 is flush with the molding top wall 184. A first side wall 190 of hood 186 is positioned to be adjacent and extend rearward of bottom molding frame 160. A second side wall 192 of hood 186 extends rearwardly from side wall 182.

The top molding 158 is also shaped to define a nose 196 that extends forward from the top wall 188. Nose 196 has a semicircular cross section profile that is downwardly directed. When moldings 156 and 158 are mated together, the opposed edges of nose 196 seat against the opposed edges of the forward end of the first slide 162. The forward end of the first slide 162 and nose 196 collectively form the opening 198 of chute 26 through which ice is discharged.

In the illustrated version of the invention, bottom and top moldings 156 and 158, respectively, are snap fitted together. Integrally formed with the bottom molding 156 are outwardly directed fingers 202. The top molding side walls 180 and 182 are each formed with a U-shaped downwardly directed bracket 204. Collectively, the fingers 202 and brackets 204 are positioned so that when the top molding 158 is positioned over the bottom molding 156, the fingers snap against surfaces integral with the brackets to hold the moldings together.

The ice chute 26 is further formed to have four tabs 206 integral with bottom molding frame 160. Two of the tabs 206 extend from the top of the frame 160 and are positioned to be aligned with the upper two auger duct protuberances 61. Two of the tabs 206 extend from the bottom of frame 160 (one tab seen) and are positioned to be aligned with the lower two auger duct protuberances.

As part of the assembly of ice dispenser 40, the ice crusher 28 is fitted against auger duct flange 58 and the ice chute 26 is fitted over the ice crusher so that crusher head 94 seats in the duct frame 160. Pairs of fasteners 208 and 210 extend through concentric openings formed in the flange protuberances 61, ice crusher ribs 140 and 142 and chute tabs 206 (openings not identified). Each pair of fasteners 208 and 210 interlock to hold the ice chute 26 and ice crusher 28 to the auger duct 42.

When the ice dispenser 40 is so assembled, the rear end of the bottom molding second slide 164 is disposed under the auger duct bypass opening 60. Top molding hood 186 extends rearwardly, towards the auger duct bypass opening 60. Thus, hood 186 extends rearwardly beyond the ice crusher 28. The rear end of the second slide 164 is disposed below bypass opening 60. However, the ice chute 26 is shaped so that both the second slide 164 and hood 186 are spaced from the auger duct 42. Specifically, the second slide 164 and hood 186 are positioned to define a space between the ice chute 26 and the auger duct 42 in which the bypass gate main body 81 can freely move.

Ice dispenser 40 also includes a lever arm 214 (FIG. 1) located immediately below ice chute 26. Lever arm 214 is pivotally mounted to a static portion of the beverage dispenser 20. The lever arm 214 is positioned relative to the ice chute 26 so that, when a container is placed under the chute opening 198, the lever arm is pivoted. A sensor 218, seen in FIG. 10, monitors the pivotal displacement of the lever arm 214. The signal generated by sensor 218 is supplied to a control unit 220 that regulates the operation of the ice dispenser 40. Also connected to the control unit 220 is a control switch 222. Switch 222 is actuated to set the dispenser 40 to discharge either cubed or crushed ice. Switch 222 is typically an SPST or SPDT switch (SPST switch shown). While not illustrated, switch 222 is mounted to the front of the beverage dispenser 20 so that it is readily accessible by the customer.

Control unit 220 may be a microcontroller, a PLA, a PGA or a set of discrete components. Based on the depression of lever arm 214 and the setting of switch 222, control unit 220 selectively actuates the auger motor 70, the bypass gate motor 84 and the ice crusher motor 144. Control unit 220 controls the operation and speed of auger motor 70, bypass gate motor 84 and crusher motor 144. Control unit 220 also monitors the current draw of each motor to determine if an ice jam has occurred. If an ice jam does occur, control unit 220 is programmed to rotate auger 62 and/or crusher blade assembly 104 in a manner so as to free the ice jam, for example, by reversing the direction of rotation of one or both of auger 62 and crusher blade assembly 104. Not illustrated is the power supply that supplies the energization signals to the motors 70, 84 and 144.

Figure 10:
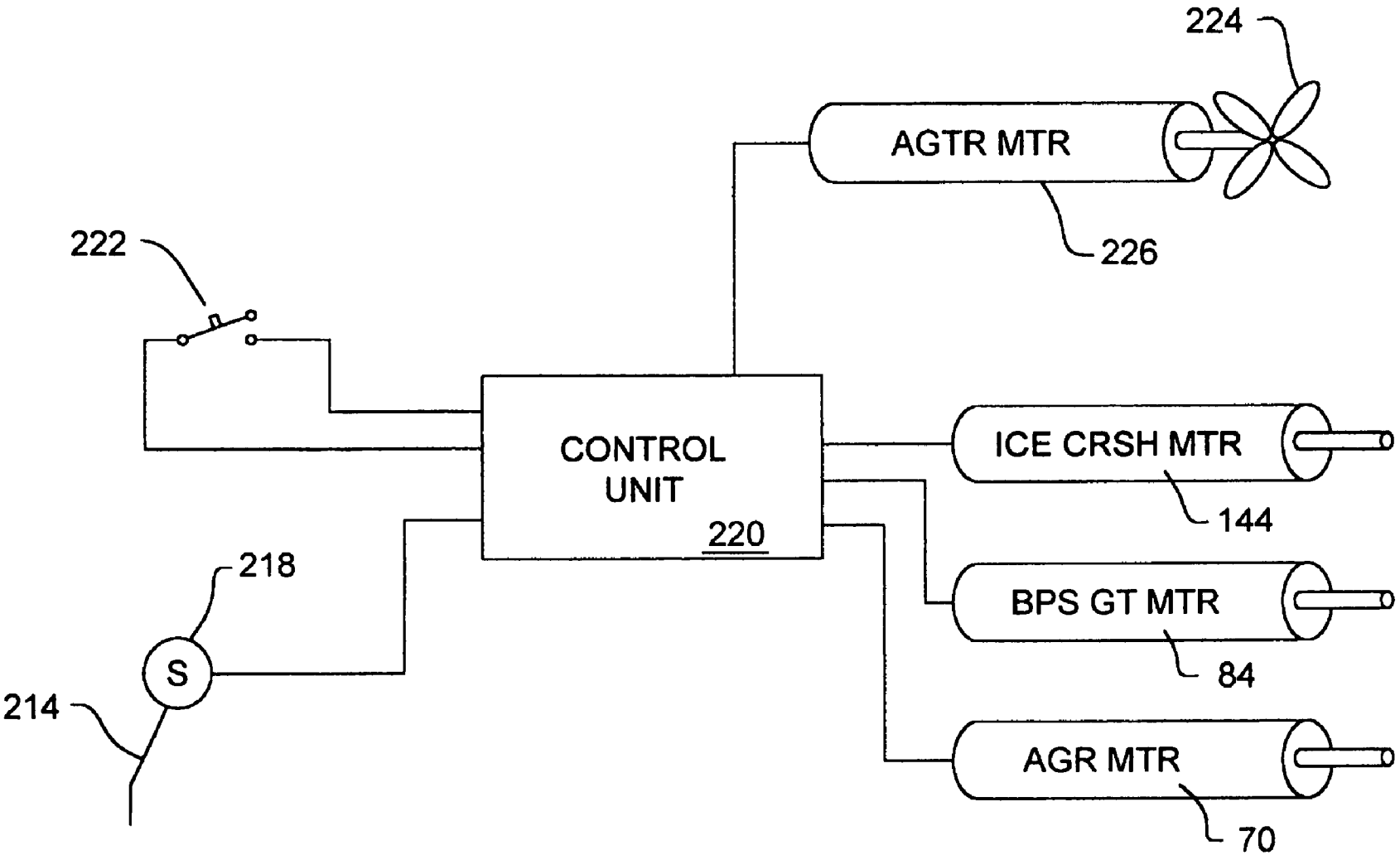
FIG. 10 is a block diagram of the control circuit of the ice dispenser of the beverage dispenser of this invention.

In some versions of the invention an agitator 224, shown diagrammatically in FIG. 10, is rotatably mounted in the ice bin 24. An agitator motor 226 is mounted to an outer wall of the ice bin 24. The agitator motor 226 is connected to the agitator 224 for periodically rotating the agitator. Agitator 224 is so rotated to prevent the cubed ice in bin 24 from congealing into large blocks that cannot pass through the ice bin opening. In some versions of the invention, control unit 220 also regulates the actuation of the agitator motor 226. Control unit 220 may be configured to actuate the agitator motor 226 whenever ice is discharged. In addition, or alternatively, the control unit 220 periodically actuates the agitator motor 226 independent of the discharge of ice.

When an individual wants an iced beverage from dispenser 20, he often initially fills the container with the desired quantity of ice. The individual first sets switch 222 to choose the form of ice desired for the beverage. If switch 222 is set to indicate a choice of cubed ice, control unit 220, if it has not already done so, actuates the bypass gate motor 84 to cause the bypass gate main body 81 to retract away from the auger duct bypass opening 60. Each time the bypass gate 80 is moved, it is moved a set distance. Therefore, for each extension and retraction of the bypass gate 80, motor 84 is actuated for a set period of time.

Once the signal from sensor 218 indicates that lever 214 is pivoted, the control unit 220 actuates auger motor 70. The auger motor 70 rotates to cause a like movement of auger 62 and paddle blade 66. This results in the movement of ice through the auger duct 42 from the end adjacent opening 46 towards the opposed end. Ice crusher motor 144 is not actuated. Consequently, a head of cubed ice develops in auger duct 42 adjacent the primary opening 56. The ice downstream of this head in the auger duct 42 is, therefore, forced out of the duct through the open bypass opening 60.

The ice discharged from bypass opening 60 flows onto the ice chute second slide 164. Gravity causes the ice to move down the second slide 164 onto the first slide 162 and be discharged through chute opening 198 into the waiting container.

Alternatively, at the start of the ice dispensing process, switch 222 is set to cause crushed ice to be dispensed. If switch 222 is not already in this state, control unit 220, upon sensing the change in switch state, actuates the bypass gate motor 84. Specifically, the bypass gate motor 84 is actuated to move the bypass gate main body 81 over the duct bypass opening 60.

Once sensor 218 transmits a signal indicating lever 214 has been pivoted, control unit 220 causes the auger motor 70 to be actuated as described above. Also during this ice dispensing process, the control unit 220 actuates the ice crusher motor 144. Thus, simultaneously, auger 62 moves ice towards the free end of the auger duct 42 and the ice crusher 28 is actuated. Once the ice reaches the free end of the auger duct 42, the paddle blades 66 force the ice out of the duct through the primary opening 56. The cubed ice is pushed against the rearwardly-directed face of the ice crusher head 94. The rotating blades 114 break the ice and force the crushed ice slivers through slots 102. The crushed ice then moves down the chute slide 162 and is discharged from chute opening 198. The rotating crusher blades 114 also add velocity to the crushed ice, resulting in an improved crushed ice dispense rate from chute opening 198.

Once the individual has filled the container with the desired quantity of cubed or crushed ice, the container is then filled with the desired beverage. The individual performs this task by placing the container under the dispensing head nozzle 32 from which that beverage is discharged. The associated lever arm 34 is pivoted. The beverage dispensing control circuit, upon the sensing of the displacement of arm 34, actuates the appropriate valves to cause the desired beverage to be discharged from the nozzle 32.

Beverage dispenser 20 of this invention does more than function as a single unit from which an individual obtains beverage and ice. Beverage dispenser 20 also allows the individual to select what form of ice, cubed or crushed, is dispensed. Thus, the beverage dispenser of this invention provides individuals with more choices regarding the form of the final beverage.

The beverage dispenser 20 of this invention is further configured so that both cubed and crushed ice are dispensed from a common opening 198 of a single chute 26. An individual cannot place the container under one chute and, due to failure to understand the operation of the dispenser, watch as ice is discharged from a second chute.

A further benefit of the construction of beverage dispenser 20 is that since the ice dispenser 40 has a single chute 26 and a single lever 214 and sensor pair 218, the number of components that need to be maintained and/or that could potentially need repair is kept to a minimum.

It should be appreciated that the foregoing is directed to one specific version of the beverage dispenser 20 of this invention. Other versions of the invention may have features different from those described in detail above.

For example, alternative drivers other than an auger may be provided to transport ice to the openings from which it is discharged or supplied to the ice crusher 28. A belt with paddles may, for example, perform this function. Further, in some versions of the invention, it may not even be necessary to provide a powered driver to deliver the ice to the locations from which it is discharged or fed to the crusher 28. Some ice dispensers 40 of this invention may rely on gravity to perform this function. In some embodiments of this version of the invention, it may still be necessary to provide a driver assembly similar to paddle blade 66 for forcing the ice against the crusher 28. In other versions, gravity also performs this function.

Similarly, the driver that pushes ice towards the ice crusher 28 may be different from the described paddle blades. In some versions of the invention, a single drive unit may be shaped to both transport ice towards the outlet openings in the duct from which the ice is discharged and force the ice towards the ice crusher 28. In other versions of the invention, the driver that moves ice towards the duct outlet openings may be driven by a different actuator than the driver that pushes the ice towards the ice crusher. Thus, in some alternative versions of the invention, one motor may actuate the auger or other driver that moves the ice through the duct while a second motor is used to simultaneously actuate both the ice crusher and the driver that forces ice towards the ice crusher.

The above versions of the invention may be incorporated into versions of the invention designed to deliver a metered amount of ice. In these versions of the invention, control unit 220 is set to first actuate the auger motor 70 for a period of time sufficient to cause ice to fill the end of the duct 42 in which the paddle blade 66 is located. Then, the motor or motors that drive the paddle blade and ice crusher is/are actuated. This causes the ice in the end of the duct to be forced out of opening 60, crushed and discharged through the chute 28.

The position of the ice crusher 28 relative to which duct opening is selectively opened or closed may be different from what has been described. Thus, in alternative versions of the invention, the opening through which ice is discharged into the ice crusher may be the opening that is selectively opened or closed.

Alternative means may also be used to direct the ice towards or away from the ice crusher 28. For example, in some versions of the invention, a pivoting gate is mounted to the duct through which the ice is flowed prior to discharge. When the gate is in a first position, the gate directs ice towards the ice crusher 28. When the gate is in a second position, the gate diverts the flow of ice away from the ice crusher 28. In some versions of the invention, when the gate is mounted to the outside of the duct, the gate has a first position in which it covers the first of the duct openings while leaving a second opening exposed; in a second position, the gate exposes the first opening and leaves the second opening covered.

The ice crusher similarly may have alternative constructions from what has been described.

It should likewise be understood that the ice dispenser 40 of this invention may be employed in assemblies other than beverage dispensers. The ice dispenser 40, for example could be installed in a commercial or residential freezer system that includes a bin in which ice is stored for discharge. The ice dispenser 40 may also be configured as a stand-alone ice dispensing appliance.

Therefore, it is an object of the appended claims to cover all such variations and modifications that come within the true spirit and scope of this invention.

What is claimed is:

1. A beverage and ice dispenser, said dispenser comprising:

a plurality of dispensing head assemblies, each said dispensing head assembly dispensing a beverage;

an ice bin;

a duct that extends from said ice bin, said duct having first and second outlets;

a chute extending from the duct first and second outlets, said chute having a discharge opening adjacent said dispensing head assemblies;

an ice crusher between said duct and said chute to crush ice discharged through the duct first outlet; and a gate moveably attached to said duct that has a first position in which said gate allows ice flow through one of the duct first or second outlets and blocks flow through the other of the duct first or second outlets, and a second position in which said gate blocks flow through said one of the duct first or second outlets, and allows flow through the other of the duct first or second outlets.

2. The beverage and ice dispenser of claim 1, further including a driver moveably mounted to said duct to move ice to the duct first and second outlets.

3. The beverage and ice dispenser of claim 2 wherein said driver comprises an auger disposed in said duct to move ice to the duct first and second outlets.

4. The beverage and ice dispenser of claim 2 further comprising a crusher motor for driving said ice crusher and a driver motor for driving said driver, said crusher motor and said driver motor being independently controllable.

5. The beverage and ice dispenser of claim 1, further including a driver moveably mounted to said duct to urge ice out of the duct first outlet and toward said ice crusher.

6. The beverage and ice dispenser of claim 1, wherein:

a first driver is moveably mounted to said duct to move ice to the first and second duct outlets; and a second driver is moveably mounted to said duct to move ice out of the duct first outlet and towards said ice crusher;

wherein said first and second drivers are attached to a common drive unit that simultaneously actuates said drivers.

7. The beverage and ice dispenser of claim 1, wherein:

said duct has an inlet opening through which ice from said ice bin is received and the first and second outlets are spaced from the inlet opening;

a first driver is moveably mounted to said duct to move ice from the inlet opening towards the first and second duct outlets;

said gate is moveably mounted to said duct to extend over and retract away from the one duct outlet with which said gate is associated; and a second driver is moveably mounted to said duct to urge ice through the duct first outlet opening and towards said ice crusher.

8. The beverage and ice dispenser of claim 1, wherein:

said duct has an inlet opening through which ice from said ice bin is received, the first outlet is distal to the inlet opening and the second outlet is proximal to the inlet opening;

said gate is moveably mounted to said duct to extend over and retract away from the duct second outlet opening; and a driver is moveably mounted to said duct to urge ice through the duct first outlet and towards said ice crusher.

9. A beverage and ice dispenser comprising:

a plurality of dispensing head assemblies, each said dispensing head assembly dispensing a beverage;

an ice bin;

a duct that extends from said ice bin, said duct having an inlet opening through which ice enters from said ice bin and first and second outlet openings spaced from the inlet opening;

a first driver moveably mounted to said duct that urges ice from the inlet opening towards the first and second outlet openings;

a gate moveably attached to said duct that has a first position in which said gate allows flow to and through one of the duct first or second outlet openings and a second position in which said gate blocks flow through said one of the duct first or second outlet openings;

an ice crusher positioned to receive ice from the duct second outlet opening; and a chute extending from the duct first opening and from said ice crusher, said chute having a single discharge opening adjacent said dispensing head assemblies.

10. The beverage and ice dispenser of claim 9, wherein said first driver is an auger.

11. The beverage and ice dispenser of claim 9 further comprising a crusher motor for driving said ice crusher and a driver motor for driving said first driver, said crusher motor and said driver motor being independently controllable.

12. The beverage and ice dispenser of claim 9, further including a second driver moveably mounted to said duct to urge ice out of the duct second opening and towards said ice crusher.

13. The beverage and ice dispenser of claim 9 wherein:

said gate is moveably mounted to said duct to extend over and retract away from the one duct outlet opening with which said gate is associated; and when said gate extends over the duct outlet opening with which said gate is associated, said gate is located between the one duct outlet opening and said chute.

14. The beverage and ice dispenser of claim 9, wherein:

the duct first outlet opening is proximal to the duct inlet opening and the duct second outlet opening is distal to the duct inlet opening;

said gate is moveably mounted to said duct to extend over and retract away from the duct first outlet opening and, when said gate extends over the duct first outlet opening, said gate is located between the duct first outlet opening and said chute;

a second driver is moveably mounted in said duct to urge ice through the duct second outlet opening and towards said ice crusher.

* * * * *

UNITED STATES PATENT AND TRADEMARK OFFICE

CERTIFICATE OF CORRECTION

PATENT NO. : 7,575,185 B2
APPLICATION NO. : 11/318698
DATED : August 18, 2009
INVENTOR(S) : Hammonds et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 903 days.

Signed and Sealed this

Seventh Day of September, 2010

David J. Kappos

David J. Kappos
*Director of the United States Patent and Trademark Office*